US005250015A

United States Patent [19]

Thornton

[11] Patent Number: 5,250,015

[45] Date of Patent: Oct. 5, 1993

[54] HYDRAULIC EXERCISE APPARATUS HAVING A MAIN CYLINDER AND A DISPLACEMENT CYLINDER

[76] Inventor: John C. Thornton, 134 Bukulla Street, Wacol, Queensland, 4076, Australia

[21] Appl. No.: 927,431

[22] PCT Filed: Mar. 22, 1991

[86] PCT No.: PCT/AU91/00109

§ 371 Date: Sep. 21, 1992

§ 102(e) Date: Sep. 21, 1992

[87] PCT Pub. No.: WO91/14482

PCT Pub. Date: Oct. 3, 1991

[30] Foreign Application Priority Data

Mar. 22, 1990 [AU] Australia ..... PJ9242
Jun. 27, 1990 [AU] Australia ..... PK0868

[51] Int. Cl.[5] ..... A63B 21/008
[52] U.S. Cl. ..... 482/112; 482/111
[58] Field of Search ..... 482/111, 112, 113

[56] References Cited

U.S. PATENT DOCUMENTS

| | | | |
|---|---|---|---|
| 1,707,449 | 4/1929 | Rodale | 482/112 |
| 2,825,563 | 3/1958 | Lawton | 482/112 |
| 3,834,696 | 9/1974 | Spector | 482/112 |
| 4,148,479 | 4/1979 | Spector | 482/112 |
| 4,183,520 | 1/1980 | Chase | 482/112 |
| 4,290,599 | 9/1981 | Berger | 482/112 |
| 4,291,787 | 9/1981 | Brentham | 482/112 |
| 4,651,986 | 3/1987 | Wang | 482/112 |
| 4,880,230 | 11/1989 | Cook | 482/113 |

*Primary Examiner*—Robert Bahr
*Assistant Examiner*—Lynne A. Reichard
*Attorney, Agent, or Firm*—Abelman Frayne & Schwab

[57] ABSTRACT

A hydraulic exercise apparatus having an elongated frame housing a main hydraulic cylinder and a displacement cylinder in liquid communication with the main hydraulic cylinder. The main hydraulic cylinder includes a main piston and the displacement cylinder includes a closure piston that is movable in response to movement of the main piston to maintain a liquid filled condition in the main cylinder regardless of the position of the main piston.

14 Claims, 6 Drawing Sheets

HYDRAULIC EXERCISE APPARATUS HAVING A MAIN CYLINDER AND A DISPLACEMENT CYLINDER

TECHNICAL FIELD

This invention relates to improvements in and relating to exercising apparatus of the type adapted to be used by humans to exercise muscles and other body parts.

BACKGROUND ART

Many different types of exercising apparatus can be purchased by persons anxious to improve their health and physical abilities. The simplest would be spring-extension stretching devices to be used manually, but other types, too numerous to enumerate, either occupy an unduly large space in storage or use, or they lack portability. A further disadvantage is that most have strong spring-recoil mechanisms which can lead to body strain or to accidents of one kind or another. Lack of fine adjustability to suit different users or various operating conditions and requirements can also be a disadvantage with most current types of exercising apparatus.

The present invention has been devised with the aforementioned current deficiencies and disadvantages in mind, and it has for its principal object the provision of improved exercising apparatus having novel features whereby it will be safer and more effective than known types in relation to portability and adjustability in particular. The invention also aims to provide such novel forms of exercising apparatus which will use non-recoil principles and which can be adapted to use in different applications so that any desired muscle can be exercised, while infinitely variable resistance can be utilised as required. Other objects and advantages of the invention will be hereinafter apparent.

DISCLOSURE OF THE INVENTION

With the foregoing and other objects in view, the invention resides broadly in exercising apparatus including:

an elongate frame;

a longitudinal hydraulic main cylinder housed in or forming part of said frame, one end of said main cylinder being fixedly mounted relative to a mounting end of said frame;

sealing means at the other end of said main cylinder through which a plunger rod is sealably slidable axially of said main cylinder;

handle means associated with that end of said plunger rod which is external of said main cylinder;

a main piston at the end of said plunger rod within said main cylinder and mounted in sealably slidable manner to define two opposite sides of said main cylinder;

adjustable aperture means interconnecting said two sides of said main cylinder for adjustably varying the permitted flow of hydraulic liquid from one to the other of said opposite sides upon movement of said plunger rod and said main piston;

a displacement cylinder mounted on said frame and having one of its ends in liquid communication with said main cylinder at one of said two opposite sides thereof, and a closure piston mounted in sealably slidable manner in the other end of said displacement cylinder and movable in response to movement of said main piston and said plunger rod to maintain a liquid-filled condition of said main cylinder regardless of the positions occupied by said main piston and said plunger rod.

Many different types of design features may be selected within the broad idea as aforementioned. For example, the displacement cylinder is preferably in spaced parallel relationship to the main hydraulic cylinder and suitably of smaller diameter, but if desired the displacement cylinder could be around and coaxial with the main cylinder.

Preferably the adjustable aperture means is provided in and extending through said main piston between the two opposite-sides of said main cylinder, there being provided adjustment-control means for said adjustable aperture means leading operatively from said main piston to said handle means. Preferably, said main piston includes a fixed piston member secured rigidly to said plunger rod, and an adjustable piston member adjustably rotatable about the axis of said main piston and said plunger rod relative to said fixed piston member, there being apertures through both said piston members adapted to be brought into selected degrees of register to vary the permitted flow according to the rotational disposition of said adjustable piston member, said adjustment-control means comprising a control rod passing rotatably through a bore of said plunger rod and extending from said adjustable piston member to said handle means, rotation-control means being provided at the handle means end of said control rod whereby the latter may be rotated to a desired extent to adjust the setting of said adjustable piston member relative to said fixed piston member.

With the abovementioned construction, the fixed piston member and adjustable piston member are suitably of disc-like form with flat co-acting faces in normally-sealing rotatable contact, and the apertures may include part-circumferential peripheral slots in each disc-like piston member for registering to desired extent upon adjustment of said adjustable piston member. On the other hand, the apertures may include a series of cylindrical apertures arranged on an arc about the plunger rod axis through each piston member and inwardly of the periphery thereof, the apertures of the two piston members being arranged to register to desired extent upon adjustment of said adjustable piston member.

In a preferred construction, the displacement cylinder has its said one end communicating with said main cylinder at the side of the latter having said sealing means through which said plunger rod passes, the parts being so made and arranged that liquid under pressure at said end of the displacment cylinder acts also to increase the sealing ability of said sealing means against leakage of liquid past said sealing means to the exterior of the main cylinder. For this purpose, the sealing means may include two spaced U-shaped sealing rings or buckets through which the plunger rod passes, the space between said rings having an entry port from the adjacent end of the displacement cylinder, a radially-apertured spacer sleeve being provided to surround the plunger rod and maintain spacing of the sealing rings.

In another preferred construction according to the invention, the closure piston may be operatively connected to said plunger rod by coupling means whereby movement of the plunger rod causes a corresponding predetermined movement of the closure piston while maintaining said liquid-filled condition of said main cylinder, the diameter of the closure piston and displacement cylinder being less than the diameter of the main cylinder and main piston so that said predetermined movement of the closure piston is over a lesser length than the movement of the plunger rod.

In one such embodiment, the coupling means may include a single cable and pulley arranged so that withdrawal of the plunger rod causes movement of the closure piston in the direction towards that end of the displacement cylinder communicating with said main cylinder.

On the other hand, the coupling means may include a single cable and plurality of pulleys arranged so that withdrawal of the plunger rod positively and instantly draws the closure piston in the direction towards that end of the displacement cylinder communicating with said main cylinder, while the return movement of the plunger rod positively and instantly draws the closure piston in the direction away from that end of the displacement cylinder communicating with said main cylinder. In yet another embodiment, the coupling means may include rack and pinion means instead of the cable and pulleys. Other features of the invention will be hereinafter apparent.

BEST METHOD OF CARRYING OUT THE INVENTION

In order that the invention may be more readily understood and put into practical effect, reference will now be made to the accompanying drawings, wherein.

Figure 10:
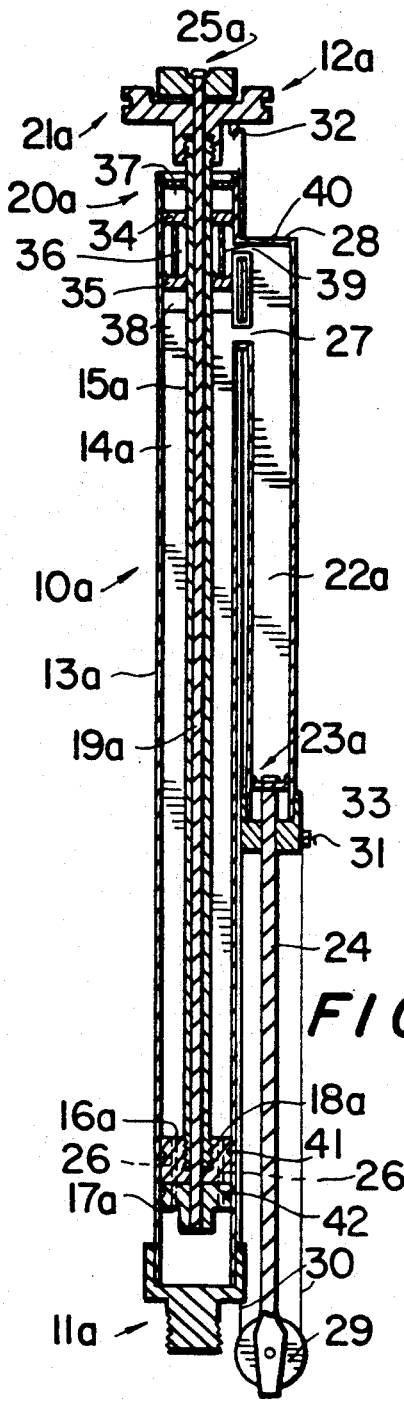
FIGS. 10 and 11 are views similar to FIGS. 7 and 8 respectively, showing a third embodiment of the invention.
Figure 11:
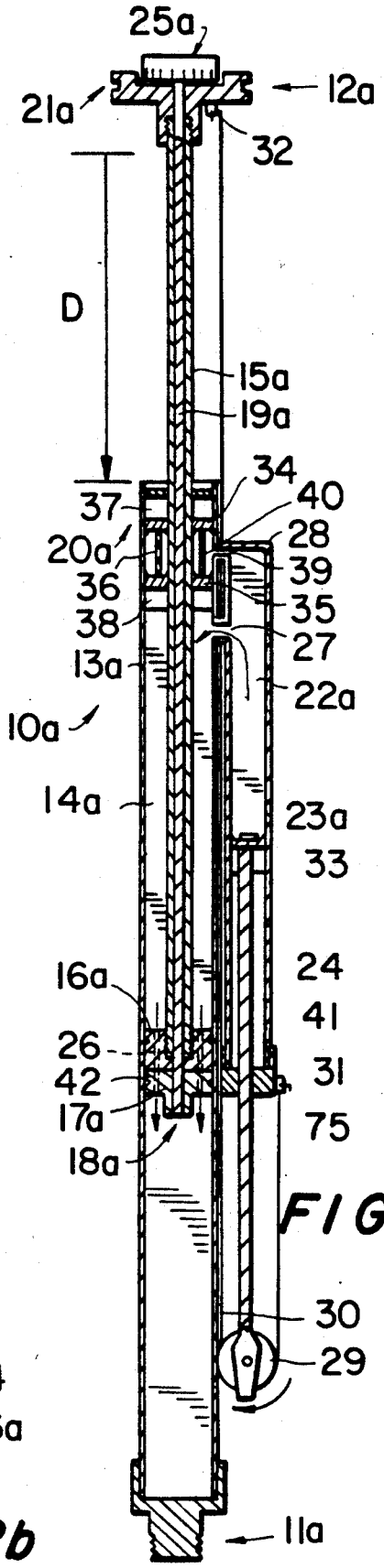
Figure 12A:
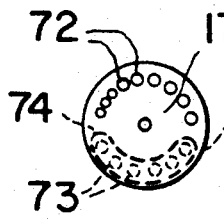
Figure 12B:
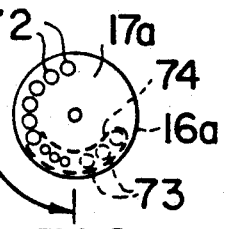
Figure 14:
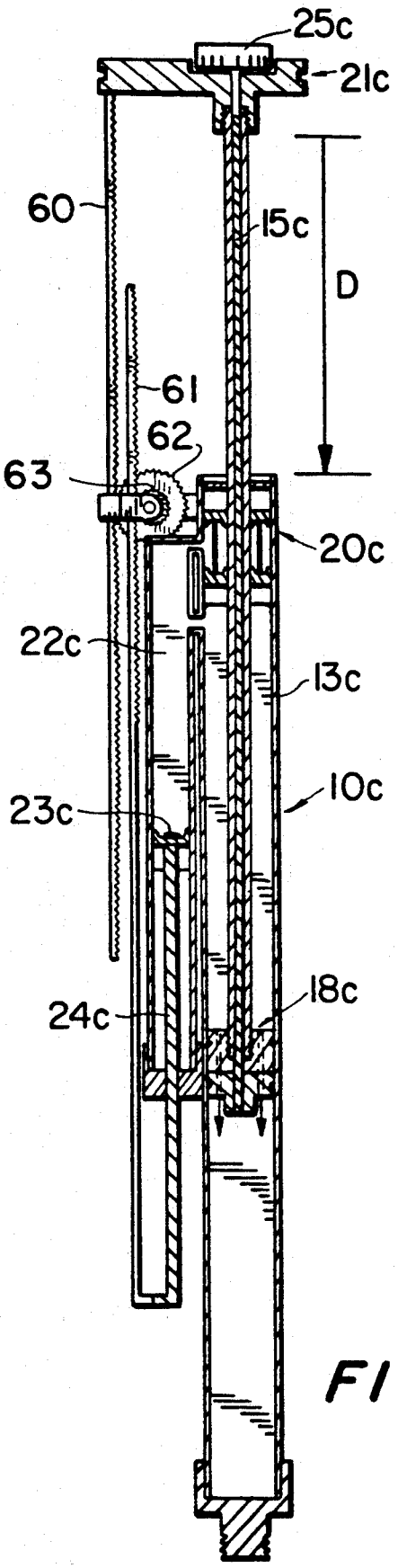
Figure 13:
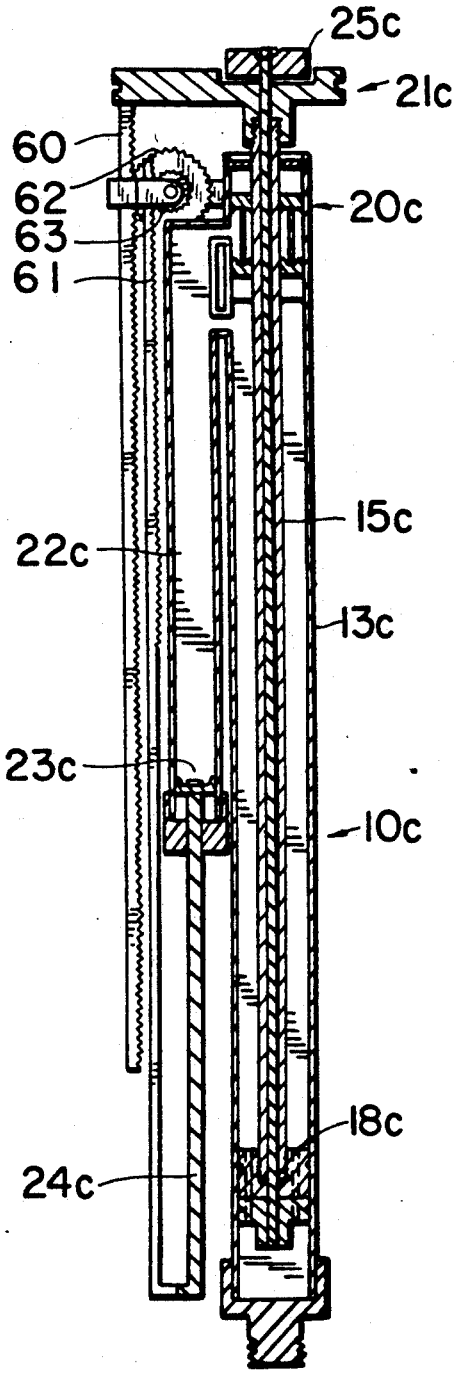

FIGS. 12A and 12B show diagrammatically the coacting of the two piston members of the apparatus of FIGS. 10 and 11, in inoperative and operative dispositions, respectively, of said piston members, and FIGS. 13 and 14 are views similar to FIGS. 10 and 11, but showing a fourth embodiment of the invention, employing rack and pinion means in lieu of the cable and pulleys system of the first embodiment of FIGS. 1 to 6.

Figure 1:
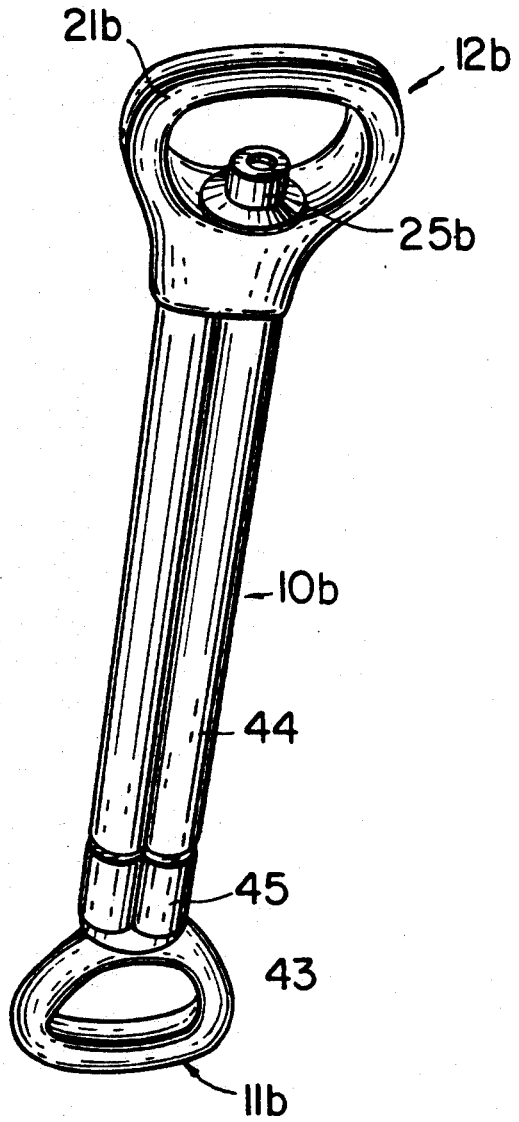
FIG. 1 shows in perspective view one form of exercising apparatus according to the invention, with the plunger rod and other movable components in inoperative or stored disposition.
Figure 2:
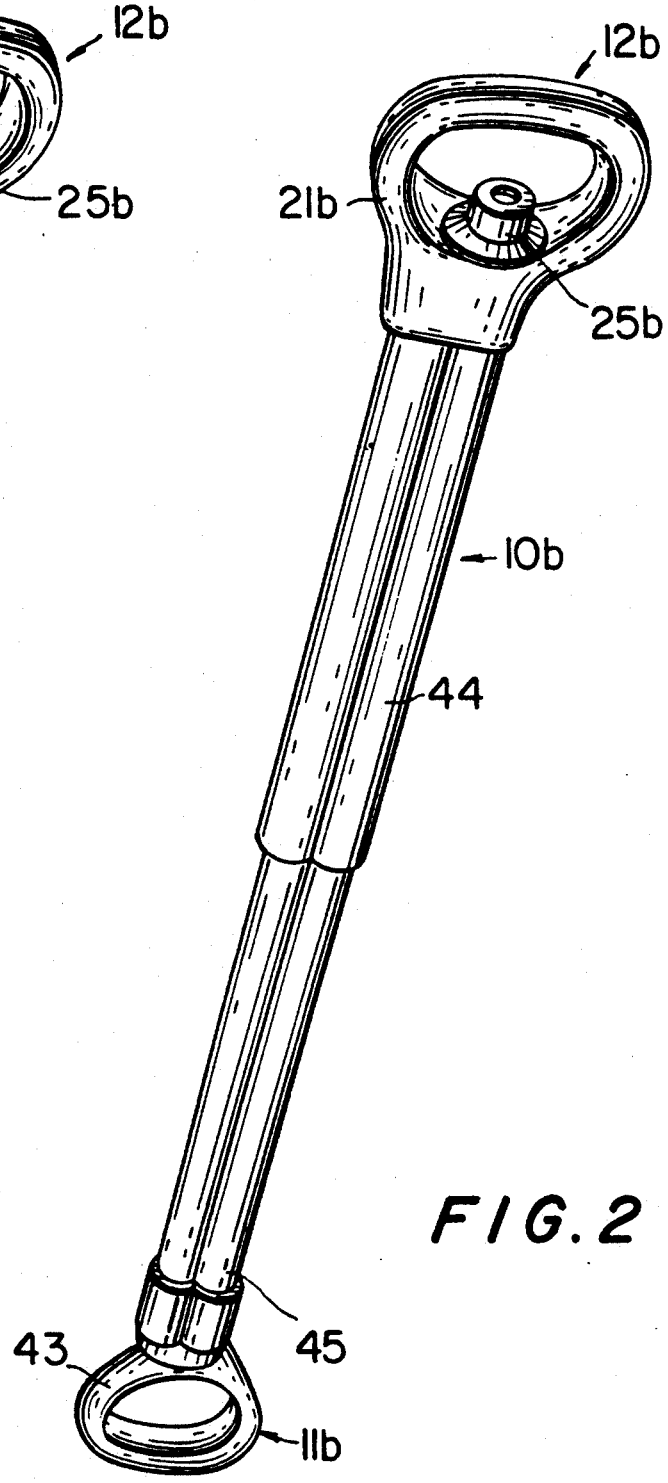
FIG. 2 is a similar perspective view to that of FIG. 1, but with the components in operative or withdrawn disposition, the plunger rod being withdrawn.
Figure 3:
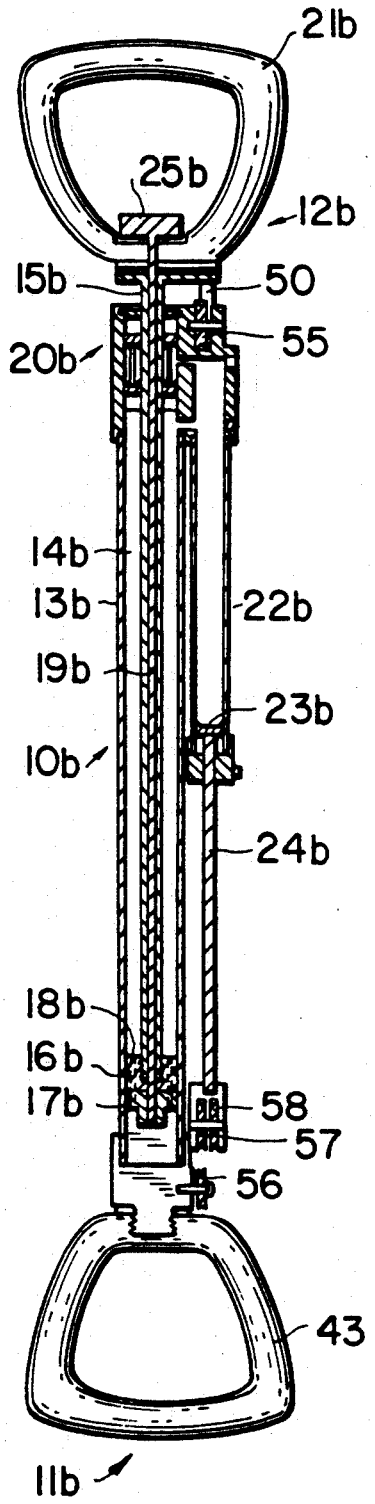
FIG. 3 is a sectional front elevational view of the apparatus of FIG. 1, with outer coverings and certain lines denoting cables omitted for the sake of clarity.
Figure 4:
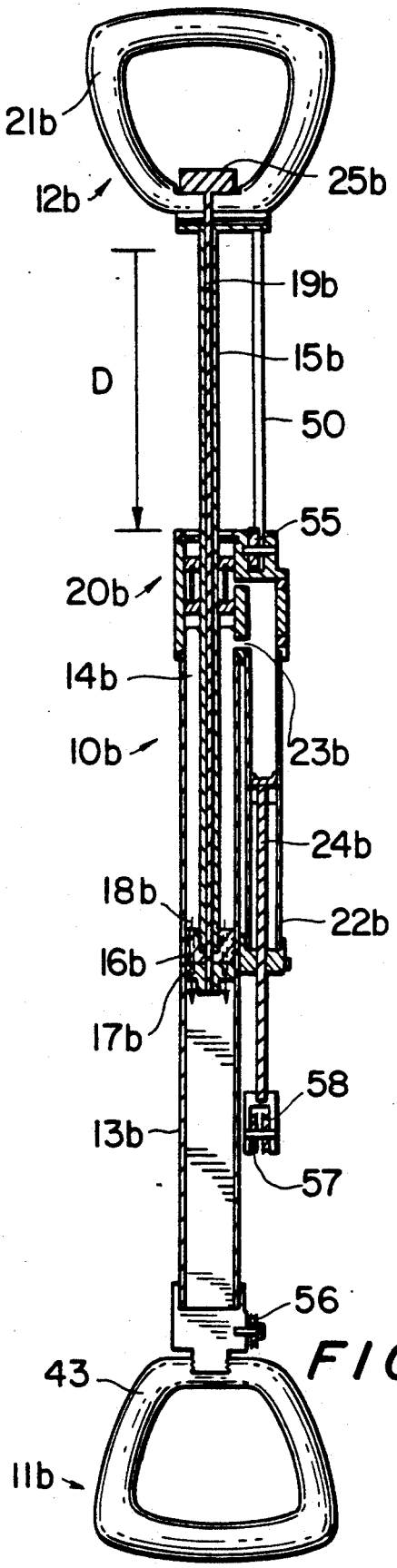
FIG. 4 is the same as FIG. 3, but showing the components in operative or withdrawn disposition.
Figure 5:
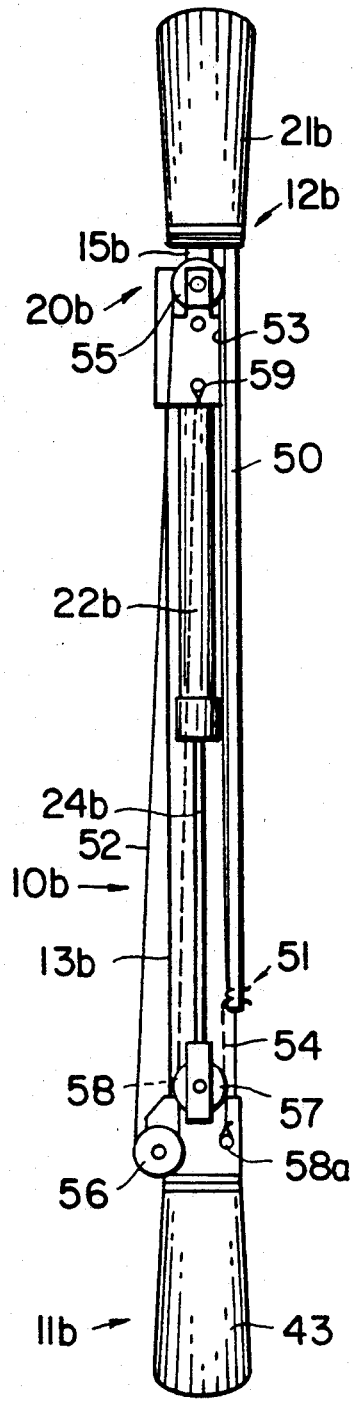
FIGS. 5 and 6 are side elevational views, corresponding to FIGS. 4 and 5 respectively, but schematically showing the cable arrangements.
Figure 6:
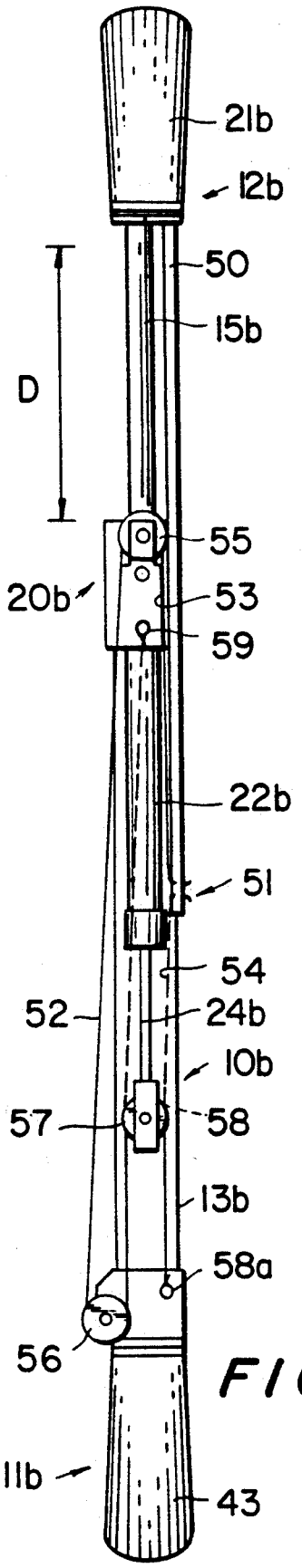

The various embodiments of the invention will illustrate that there is provided an adjustable damper-type exercising device designed for use in the conventional application of two-handed expander as apparent from FIGS. 1 and 2 in particular, or for attachment to frames for exercising locations and/or to fixed brackets, or as the hydraulic part of elaborate exercising machines or the like. The simplest form of the invention will be clear from the embodiment illustrated second and shown in FIGS. 7 and 8 where the elongate frame is indicated generally by the numeral 10 and houses a longitudinal hydraulic main cylinder 13 which in this construction forms part of the frame 10. The frame 10 in this instance has affixed mounting end 11 and a movable or handle end section or assembly 12.

Figure 9A:
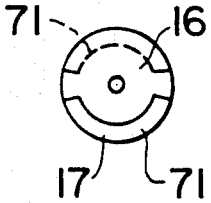
FIGS. 9A and 9B show diagrammatically the coacting of the two piston members of the apparatus of FIGS. 7 and 8, in inoperative and operative dispositions, respectively, of said piston members.
Figure 9B:
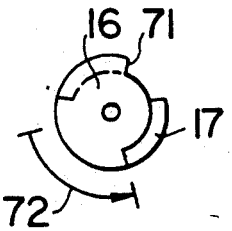

The longitudinal main cylinder 13 defines a main chamber 14 to be filled with hydraulic oil as the necessary non-compressible liquid which is constrained to move only within the chamber 14. The end of the main cylinder 13 opposite the mounting end 11 has sealing means through which a hollow tubular plunger rod 15 is sealably slidable axially of the cylinder 13, being connected at its inner end to a main piston 18 which is able to be moved by the plunger rod 15 in sealably slidable manner to define two opposite sides of the main cylinder 13 at opposite ends of the main chamber 14. The main piston 18 comprises two piston members 16 and 17 which in this case are of disc-like form having machined faces-in-tight but relatively rotational contact. The lower end of the plunger rod 15 (when considered in the disposition illustrated) is secured to the uppermost piston member 16 which constitutes a fixed piston member, while the other piston member 17 is secured to the lower extremity of an innermost control rod 19 extending through an axial bore of the fixed piston member 16 and axially upwards through the plunger rod 15. As will be apparent from the positions shown diagrammatically in FIGS. 9A and 9B, which are views from beneath, the piston members 16 and 17 have identical part-circumferential peripheral slots 71 which can be out of register as shown in FIG. 9A to prevent through-flow completely, or by rotating the adjustable lower piston member 17 as shown by the arrow 72 of FIG. 9B, the apertures 71 may be brought into register to desired extent to allow flow of liquid through the main piston 18 at desired rate.

The free end of the plunger rod 15 (which is the upper end as illustrated) extends through any suitable sealing means comprising both air and oil seal members, as illustrated, within an upper sealing cap 20, and it has handle assembly members secured to its upper end as illustrated at 21. It will be seen from FIG. 8 that the handle end may be moved to withdraw the plunger rod 15 or subsequently retract it, various pressures being experienced as resistance to movement of the piston during such movements, with different resistances according to the degree of register of the apertures 71 through the faces of the piston members 16 and 17 of the main piston 18 as the latter is moved at the inner end of the plunger rod 15. The end of the main cylinder 13 opposite the sealing cap 20 connects via a connector vessel 73 with the lower open end of a displacement cylinder 22 mounted in spaced parallel relationship to the main cylinder 13 but of lesser diameter as illustrated. According to the disposition of the plunger rod 15 in the main cylinder 13, oil will be displaced up the displacement cylinder 22 against a movable closure piston 23 mounted in sealably slidable manner, the piston 23 being biassed in this instance by spring loading in the form of a spring 24 held by retainer cap 74 arranged to urge the closure piston normally in the direction towards the connector vessel 73. When the plunger rod 15 is drawn upwards in operative manner through the displacement stroke indicated by the arrow "D" in FIG. 8, the vacuum normally created is offset by oil moving back to the lower end of the main cylinder 13 under the pressure of the spring 24, ensuring that there is maintained a liquid-filled condition of the main cylinder 13 at all times regardless of the positions occupied by the main piston 18 and the plunger rod 15.

Adjustment of the adjustable piston member 17 of the main piston 18 can be made from outside the apparatus and main chamber 14 by means of a dial 25 at the handle 21 permitting rotation of the control rod 19 which causes rotation of the adjustable member 17 relative to the fixed piston member 16. This adjustment at the dial 25 allows a desired flow of oil to pass through the main piston 18, resulting in pressure against movement of the plunger rod 15 in and out, with the amount of resisting pressure depending upon the size of the adjustable aperture means 71 through which the oil is forced. It will be noted that the resistance will remain constant through the full stroke in or out, and it works against the viscosity of the oil, and not through pressure of oil.

Figure 7:
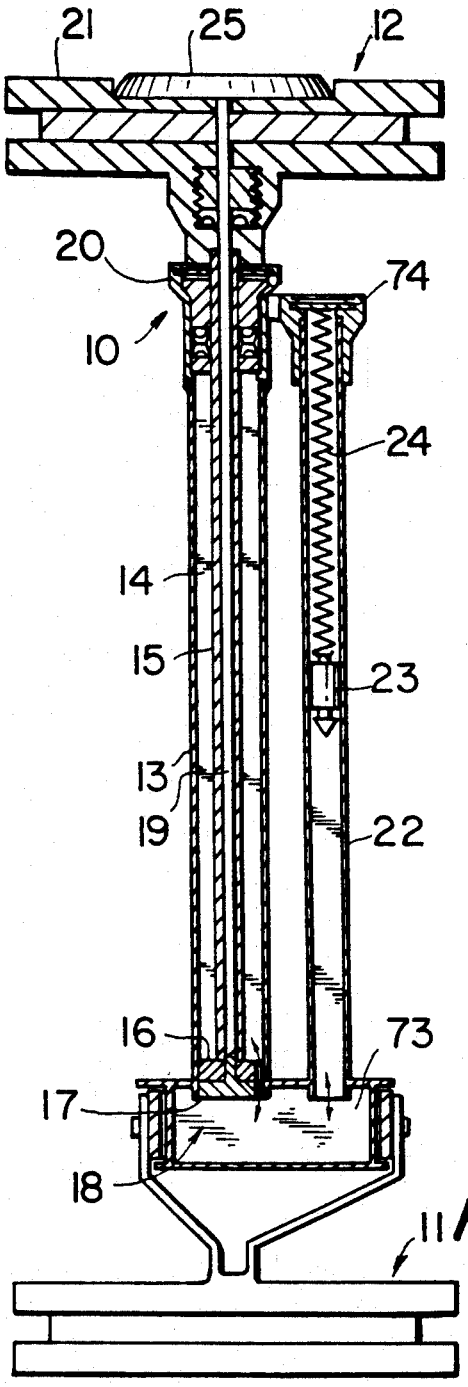
FIG. 7 shows diagrammatically in sectional front elevation, a second embodiment of the invention in its simplest form, the plunger rod and other movable components being in inoperative or stored disposition.
Figure 8:
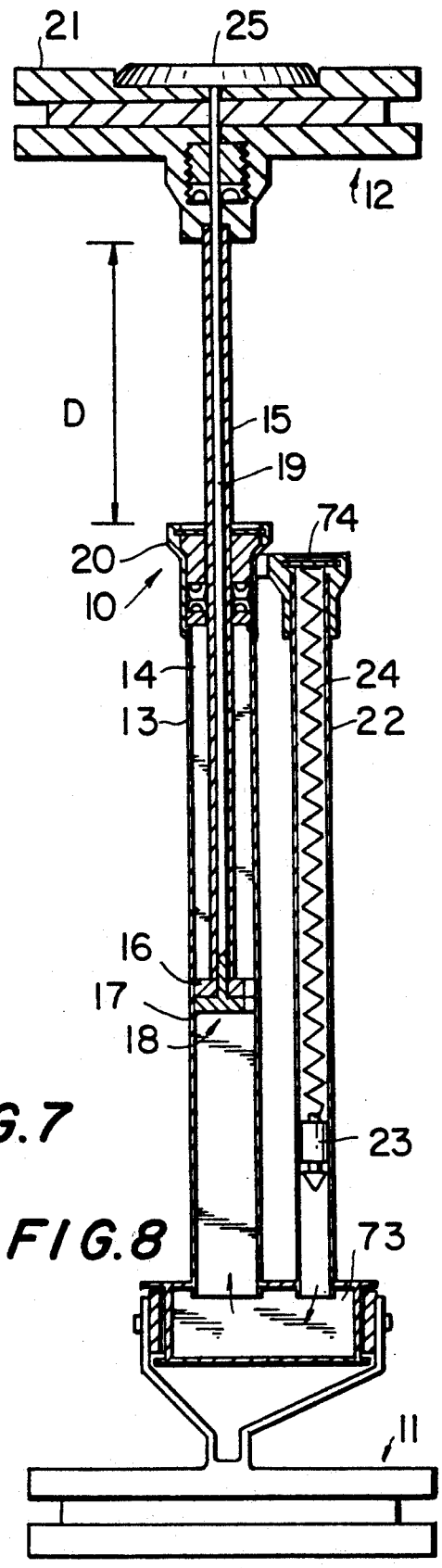
FIG. 8 is the same as FIG. 7, but showing the components in operative or withdrawn disposition.

The manner of using the embodiment of FIGS. 7 and 8 will be clear from these views and the aforegoing description, the varied resistance being able to be extended between "easy" and "almost immovable" according to the setting at the dial 25. Because there are no recoil forces in or out, the exercise action may be stopped at any point of the stroke, whereafter pressure is needed in equal and opposite extents to bring the plunger rod 15 back to the starting point, this being a strong safety feature. The invention provides a system which is sealed with respect to the outer atmosphere, the inner spaces being filled with a non-compressible liquid which is displaced in either direction by the main piston through apertures in the main piston from one side of the main cylinder to the other on opposite sides of the main piston, while the force to be overcome in moving the main piston arises from controlled throttling of the non-compressible liquid when the latter is set into motion by the piston for passage through the apertures in the piston.

Turning next to the embodiment illustrated in FIGS. 10 and 11, this may be readily and simply compared with the embodiment of FIGS. 7 and 8, and the same basic components are identified by using the same numerals suffixed by the letter "*a*". The frame 10*a* is elongated to extend between a fixed mounting end 11*a* and a movable end 12*a*, there being a main cylinder 13*a* defining a main chamber 14*a* to be filled with hydraulic oil. Axially within the main cylinder 13*a* is a hollow plunger rod 15*a* connected at its lower end (in the disposition illustrated) to the upper fixed piston plate or member 16*a* of the main piston 18*a*, there being also a lower adjustable piston plate or member 17*a* secured to an innermost control rod 19*a* extending up through the plunger rod 15*a*. The members 16*a* and 17*a* have machined faces in tight contact but relative rotation is obtained by turning the control rod 19*a* which causes apertures to register to desired extent to give infinitely variable flow from one side of the piston 18*a* to the other. In this case, dotted lines indicate passages 26 when flow is allowed by the relative disposition of the members 16*a* and 17*a*. As will be apparent from the positions shown diagrammatically in FIGS. 12A and 12B, which are views from beneath, the adjustable piston member 17*a* has a series of cylindrical apertures 72 arranged on an arc traced out about its axis but inwardly of its periphery. These increase progressively in diameter and may communicate according to the degree of rotation with larger equally-spaced openings 73 partway through the upper fixed member 16*a* and leading from an extended arcuate slot 74 for ease of flow. However, alternative design details may be easily devised for the nature of the apertures of the two piston members and the methods whereby these are secured in relative rotatable manner to the plunger rod on the one hand and to the control rod on the other hand.

The upper end of the plunger rod 15*a* extends through air and oil seal members held within an upper cap assembly 20*a* and it has handle assembly members secured to its upper end as indicated at 21*a*. A varied pressure resistance is felt at the handle end 21*a* as the plunger rod 15*a* is moved thereby in and out of the chamber 14*a*, the different resistances being caused by changing the degree of rotation of the apertures, such as the apertures 72, through the piston members 16*a* and 17*a* of the piston 18*a* which is movable with the end of the plunger rod 15*a*. As the latter is moved in and out of the chamber 14*a*, oil is displaced from and to a displacement cylinder 22*a*, the free end of which has a closure piston 23*a* arranged to follow the plunger rod 15*a* as later described. If the plunger rod 15*a* is in the down or retracted attitude shown in FIG. 10, oil will have been forced to transfer from the closed lower end of the main cylinder 13*a* through the main piston 18*a*, this embodiment being novel over that of FIGS. 7 and 8 in that the displacement cylinder 22*a* is in liquid communication with the upper end of the main cylinder 13*a* through an oil transfer opening 27. With the handle members 21*a* down or "in" as in FIG. 10, the displacement cylinder 22*a* will thus be filled between the upper closed end 28 of the cylinder 22*a* and the movable closure piston 23*a*.

When the handle members 21*a* have moved through the displacement stroke of the arrow "D" to the position shown in FIG. 11, oil will be forced to pass through the main piston 18*a* in a downward direction to fill that part of the chamber 14*a* beneath the piston 18*a*. It will be evident that withdrawal of the plunger rod 15*a* allows for a greater volume of oil in the chamber 14*a* equal to the volume occupied otherwise by the plunger rod 15*a*. Thus, whereas the embodiment of FIGS. 7 and 8 uses a closure piston 23 subjected to the action of a spring 24, the closure piston 23*a* of FIGS. 10 and 11 is a piston mounted on a guide rod 24 movable sealably through a guide 75 at the end of the displacement cylinder 22*a*.

To avoid the possible uncertainties of operation which might result from the closure piston being movable only in conjunction with an independent spring, I provide in the embodiments of FIGS. 10 and 11, a freely rotatable pulley 29 at the free outer end of the guide rod 24*a*. Passing round the pulley 29 is a flexible wire or inextensible cable 30 which has one end affixed at 31 to the displacement cylinder 22*a* while its other end is affixed at 32 relative to the plunger rod 15*a* through its outer handle end 12*a*. Because of the pulley action, the long stroke of the plunger rod 15*a* is accompanied by a small proportional movement of the guide rod 24*a*—suitably one-half or similar predetermined relationship according to the relative diameters of the cylinders. The dimensions are chosen so that the closure piston 23*a* is in position to ensure that the oil volume is properly contained at the correct pressure while the flexible wire or cable 30 is both effective and taut at all times, with withdrawal of the plunger rod 15*a* causing movement of the closure piston 23*a* towards that end of the displacement cylinder which communicates with the main cylinder.

It will be noted that the replacement of the spring of FIG. 7 by the guide rod 24*a* and pulley arrangement 29 gives a major benefit because the closure piston 23*a* is constrained to move-correctly and yet it can be assured of maximum sealing by the provision of 0-rings or the like as indicated at 33. This is partly possible because the oil transfer opening 27 is located towards the upper end of the displacement cylinder 22*a* adjacent the upper end of the chamber 14*a*, being a reversed arrangement compared with that of the embodiment of FIGS. 7 and 8. A resultant advantage is that the upper cap assembly 20*a* for the main cylinder 13*a* may incorporate a sealing gland comprising upper and lower opposed flexible U-shaped rings, buckets or cups 34 and 35 held apart by a spacer sleeve 36, restrained by flanges of the sealing rings 34 and 35 as illustrated, to be concentric about the plunger rod 15*a*. Held towards one another are upper and lower centrally apertured plastic guide rings 37 and 38 to urge the rings 34 and 35 towards one another and against the sleeve 36 so that the sealing rings grip firmly against the plunger rod 15*a*, there being a radial aperture 39 from the cylinder 22*a* leading into the sealing gland between the sealing rings 34 and 35 so that oil may occupy the available space by virtue of a hole 40 radially through the spacer sleeve 36. It will be apparent that the creation of pressure in the main cylinder 13*a* and displacement cylinder 22*a* results in that pressure acting against both cups 34 and 35 to increase the sealing effects relative to the slidable plunger rod 15*a*.

With regard to operation, it is important that the dimensions be predetermined and designed for maximum efficiency, it being necessary that the withdrawn displacement section of the plunger rod 15*a* has a total volume equal to the displacement volume in the displacement cylinder 22*a* through resultant movement of the guide rod 24*a* for the closure piston 23*a*. The adjustable piston member or plate or disc 17*a* of the piston 18*a* is rotated by the dial 25*a*, and to ensure efficiency O-rings 41 and 42 can be provided around the piston members 16*a* and 17*a*, as illustrated, allowing for sealing on axial sliding and turning of the movable piston member, but without the piston 18*a* binding against the wall of the chamber 14*a*. Of the upper and lower sealing rings 34 and 35, the upper one 34 is effective as an oil-leak seal, while the lower one is principally an air-stop seal. Preferably a further O-ring (not shown) is provided about the control rod 19*a* to ensure sealing at its end adjacent the dial 25*a*.

The same general principles, together with further features, are illustrated in the refined embodiment of the invention shown in FIGS. 1 to 6, in which similar parts are given the same numerals as before followed by the letter "*b*". This is set up as a two-handed manual form in which the frame 10*b* has at its end 12*b* *a* handle 21*b* fitted with a dial 25*b*, the other end 11*b* also being provided with a similar handle 43. As shown only in FIGS. 1 and 2, the two handles 21*b* and 43 are secured to respective mechanism housings 44 and 45 which are slidable telescopically as the plunger rod 15*b* is moved in and out. It will be noted that the arrangements of main cylinder 13*b*, plunger rod 15*b*, displacement cylinder 22*b*, closure piston 23*b* and guide rod 24*b* are the same as in FIGS. 10 and 11, except that the pulley and,. cable arrangements have been changed so that withdrawal of the plunger rod 15*b* positively and instantly draws the closure piston 23*b* in the same direction which is towards that end of the displacement cylinder 22*b* communicating with the main cylinder 13*b*, while return movement of the plunger rod 15*b* positively and instantly draws the closure piston 23*b* in the opposite direction.

For these purposes, the sealing cap 20*b* is modified to provide a guide for a plunger-follower rod 50 parallel to the plunger rod 15*b* and secured at one end to the same mounting adjacent the handle 21*b* for sliding movement with the plunger rod 15*b*. The free end of rod 50 is secured at 51 to a cable 52 having an upward run 53 and a downward run 54. The upward run 53 extends along the plunger-follower rod 50 to the sealing cap 20*b* where it passes over an uppermost pulley 55 on said cap 20*b* and then right down to a lowermost pulley 56 mounted rotatably adjacent the bottom handle 11*b*, thereafter passing up and over a pulley 58 on the free end of the guide rod 24*b* before finally passing down and being secured at 58 to the bottom handle 11*b*. On the other hand, the said downward run 54 of the cable 52 extends down to and around another pulley 58 on the free end of the guide rod 24*b* (about the same axis as that of the pulley 57) and then upwards to have its end secured at 59 to the top cap 20*b*. The cable sections themselves are omitted from FIGS. 3 and 4 for the sake of clarity but are shown diagrammatically in FIGS. 5 and 6, where the cable 52 has its upward run 53 shown in full outline and its downward run 54 shown in dotted outline. The connection at 51 is the equivalent of a clamping arrangement for a continuous run so that the effective cable length remains continuous and taut at all times.

The purpose of this type of cable arrangement is to overcome possible disadvantages of the other embodiments of FIGS. 7 and 8 and FIGS. 10 and 11 so far as possible air-entry to the cylinders 13*b* and 22*b* might occur as a result of prolonged use. If air should enter, oil would be displaced resulting in less movement; the oil would became aerated resulting in movement which could be unsmooth, erratic or jerky, or even noisy; while additionally any air present would be subject to temperature change which might result in expanding air pushing some oil out, whereafter more air could be sucked in when the conditions cool. In such a case, the oil seals which are designed to keep the oil in would allow air to be sucked in past the oil seals when the air shrinks again. The aforementioned problems arise when there is fast movement of the handle in the closing direction and oil cannot pass quickly enough from the side of the main cylinder opposite the main seal for the plunger rod, resulting in a slight vacuum effect between the piston and seal so that air may be drawn in where the plunger rod passes through its seal. By coupling the plunger rod to the closure piston rod by the cable and pulley arrangements shown in FIGS. 3 to 6, there will be the type of positive and instant movements giving positive pressure to the requirements of the seal for the plunger rod.

As an alternative to the pulley arrangements of the embodiment just described with reference to FIGS. 3 to 6, there may be rack and pinion arrangements as shown in the embodiment of FIGS. 13 and 14 in which the components are otherwise similar, like components being given the same numerals suffixed by the letter "c". The frame 10c, main cylinder 13c, plunger rod 15c, piston 18c, sealing cap 20c, dial 25c, handle 21c, displacement cylinder 22c, closure piston 23c and control rod 24c are also generally identical with those of FIGS. 10 and 11. However, comparison is to be made with the embodiment of FIGS. 3 and 4 in that the plunger-follower rod 50 is replaced by a follower rack 60 parallel to the plunger rod 15c and movable therewith in spaced parallel relationship. Also, the guide rod 24c for the closure piston 23c has its free end coupled to a follower rack 61, the two follower racks 60 and 61 meshing with two pinions 62 and 63 secured rigidly on a common axis of rotation on the frame adjacent the cap 20c to rotate freely but in unison.

While the several illustrated embodiments will be seen to achieve the objects for which the invention has been devised, it will be obvious that they illustrate how many further modifications of constructional detail and design may be made, as will be readily apparent to persons skilled in the art, without departing from the scope and ambit of the invention as defined by the appended claims.

CLAIM:

1. Exercising apparatus including:

an elongate frame;

a longitudinal hydraulic main cylinder housed in or forming part of said frame, one end of said main cylinder being fixedly mounted relative to a mounting end of said frame;

sealing means at the other end of said main cylinder through which a plunger rod is sealably slidable axially of said main cylinder;

handle means associated with that end of said plunger rod which is external of said main cylinder;

a main piston at the end of said plunger rod within said main cylinder and mounted in sealably slidable manner to define two opposite sides of said main cylinder;

adjustable aperture means interconnecting said two sides of said main cylinder for adjustably varying the permitted flow of hydraulic liquid from one to the other of said opposite sides upon movement of said plunger rod and said main piston;

a displacement cylinder mounted on said frame and having one of its ends in liquid communication with said main cylinder at one of said two opposite sides thereof, and a closure piston mounted in sealably slidable manner in the other end of said displacement cylinder and movable in response to movement of said main piston and said plunger rod to maintain a liquid-filled condition of said main cylinder regardless of the positions occupied by said main piston and said plunger rod.

2. Exercising apparatus according to claim 1., wherein said main cylinder and said displacement cylinder are mounted about spaced parallel longitudinal axes with their external peripheries in contact or in closely adjacent relationship.

3. Exercising apparatus according to claim 1, wherein said adjustable aperture means is provided in and extending through said main piston between the two opposite sides of said main cylinder, and wherein there is provided adjustment-control means for said adjustable aperture means leading operatively from said main piston to said handle means.

4. Exercising apparatus according to claim 3, wherein said main piston includes a fixed piston member secured rigidly to said plunger rod, and an adjustable piston member adjustably rotatable about the axis of said main piston and said plunger rod relative to said fixed piston member, there being apertures through both said piston members adapted to be brought into selected degrees of register to vary the permitted flow according to the rotational disposition of said adjustable piston member, said adjustment-control means comprising a control rod passing rotatably through a bore of said plunger rod and extending from said adjustable piston member to said handle means, rotation-control means being provided at the handle means end of said control rod whereby the latter may be rotated to a desired extent to adjust the setting of said adjustable piston member relative to said fixed piston member.

5. Exercising apparatus according to claim 4, wherein said fixed piston member and said adjustable piston member are of disc-like form with flat co-acting faces in normally-sealing rotatable contact, and wherein the apertures include part-circumferential peripheral slots in each disc-like piston member for registering to desired extent upon adjustment of said adjustable piston member.

6. Exercising apparatus according to claim 4, wherein said fixed piston member and said adjustable piston member are of disc-like form with flat co-acting faces in normally-sealing rotatable contact, and wherein the apertures include a series of cylindrical apertures arranged on an arc about the plunger rod axis through each piston member and inwardly of the periphery thereof, the apertures of the two piston members being arranged to register to desired extent upon adjustment of said adjustable piston member.

7. Exercising apparatus according to claim 6, wherein the series of cylindrical apertures through at least one of the piston members increase progressively in diameter in the direction of the arc on which they are arranged.

8. Exercising apparatus according to claim 1, wherein said displacement cylinder has its said one end communicating with said main cylinder at the side of the latter having said sealing means through which said plunger rod passes, the parts being so made and arranged that liquid under pressure at said end of the displacement cylinder acts also to increase the sealing ability of said sealing means against leakage of liquid past said sealing means to the exterior of the main cylinder.

9. Exercising apparatus according to claim 8, wherein said sealing means includes two spaced U-shaped sealing rings or buckets through which the plunger rod passes, the space between said rings having an entry port from the adjacent end of the displacement cylinder, a radially-apertured spacer sleeve being provided to surround the plunger rod and maintain spacing of the sealing rings.

10. Exercising apparatus according to claim 1, wherein the closure piston is operatively connected to said plunger rod by coupling means whereby movement of the plunger rod causes a corresponding predetermined movement of the closure piston while maintaining said liquid-filled condition of said main cylinder, the diameter of the closure piston and displacement cylinder being less than the diameter of the main cylinder and main piston so that said predetermined movement of the closure piston is over a lesser length than the movement of the plunger rod.

11. Exercising apparatus according to claim 10, wherein said coupling means includes a single cable and pulley arranged so that withdrawal of the plunger rod causes movement of the closure piston in the direction towards that end of the displacement cylinder communicating with said main cylinder.

12. Exercising apparatus according to claim 10, wherein said coupling means includes a single cable and a plurality of pulleys arranged so that withdrawal of the plunger rod positively and instantly draws the closure piston in the direction towards that end of the displacement cylinder communicating with said main cylinder, while the return movement of the plunger rod positively and instantly draws the closure piston in the direction away from that end of the displacement cylinder communicating with said main cylinder.

13. Exercising apparatus according to claim 10, wherein said coupling means includes rack and pinion means, there being respective racks operatively coupled to each of said plunger rod and closure piston and cooperating via said pinion means whereby withdrawal of the plunger rod positively and instantly draws the closure piston in the direction towards that end of the displacement cylinder communicating with said main cylinder, while the return movement of the plunger rod positively and instantly draws the closure piston in the direction away from that end of the displacement cylinder communicating with said main cylinder.

14. Exercising apparatus according to claim 1, wherein said closure piston of said displacement cylinder is biassed by spring-loading means arranged to urge said closure piston normally in the direction towards that end of said displacement cylinder which is in liquid communication with said main cylinder.

* * * * *